US009024527B2

(12) United States Patent
Ushakov et al.

(10) Patent No.: US 9,024,527 B2
(45) Date of Patent: May 5, 2015

(54) DEVICE FOR GENERATING SHORT-WAVELENGTH ELECTROMAGNETIC RADIATION BASED ON A GAS DISCHARGE PLASMA

(71) Applicant: XTREME technologies GmbH, Aachen (DE)

(72) Inventors: Andrey Ushakov, Aachen (DE); Albert Brals, Beek en Donk (NL); Christian G. N. H. M. Cloin, Eindhoven (NL)

(73) Assignee: USHIO Denki Kabushiki Kaisha, Tokyo-to (JP)

( * ) Notice: Subject to any disclaimer, the term of this patent is extended or adjusted under 35 U.S.C. 154(b) by 51 days.

(21) Appl. No.: 14/053,822

(22) Filed: Oct. 15, 2013

(65) Prior Publication Data

US 2014/0103807 A1 Apr. 17, 2014

(30) Foreign Application Priority Data

Oct. 15, 2012 (DE) ..... 10 2012 109 809

(51) Int. Cl.
*G21K 5/00* (2006.01)
*H05G 2/00* (2006.01)

(52) U.S. Cl.
CPC . *G21K 5/00* (2013.01); *H05G 2/003* (2013.01)

(58) Field of Classification Search
CPC ..... G21K 5/00; H05G 2/00
USPC ..... 315/111.21; 378/144; 250/504 R; 372/76, 81, 82
See application file for complete search history.

(56) References Cited

U.S. PATENT DOCUMENTS

| | | | | |
|---|---|---|---|---|
| 7,531,820 | B2 | 5/2009 | Hergenhan | |
| 7,619,232 | B2 | 11/2009 | Schmidt | |
| 7,630,475 | B2 | 12/2009 | Neff | |
| 7,800,086 | B2 | 9/2010 | Ziener | |
| 2007/0152175 | A1 * | 7/2007 | Moors et al. | 250/493.1 |
| 2011/0133621 | A1 * | 6/2011 | Zhokhavets et al. | 313/46 |

FOREIGN PATENT DOCUMENTS

WO 20090031104 A1 3/2009

* cited by examiner

*Primary Examiner* — Daniel D Chang
(74) *Attorney, Agent, or Firm* — Patentbar International, P.C.

(57) ABSTRACT

A device for generating short-wavelength electromagnetic radiation based on a gas discharge plasma calls for suppressing droplet formation of liquid coating material that is applied to disk electrodes rotated at high rotational frequencies and ensuring a uniform layer thickness. The device has two rotating disk electrodes, each having two lateral surfaces and a circumferential surface, provided with a reservoir with liquid coating material and a wiper for removing excess coating material. The wiper, which has a U-shaped form comprising two legs parallel to the lateral surfaces of the disk electrode and a crosspiece transversely over the circumferential surface, is at least axially movably supported and has impingement elements at the legs so that it is automatically axially adjustable by means of the coating material which is transported on the lateral surfaces and pressed into the gap during the rotation of the disk electrode.

11 Claims, 5 Drawing Sheets

DEVICE FOR GENERATING SHORT-WAVELENGTH ELECTROMAGNETIC RADIATION BASED ON A GAS DISCHARGE PLASMA

RELATED APPLICATIONS

This application claims priority to German Patent Application No. DE 10 2012 109 809.3, filed Oct. 15, 2012, which is incorporated herein by reference in its entirety.

FIELD OF THE INVENTION

The invention is directed to a device for generating short-wavelength electromagnetic radiation based on a gas discharge plasma such as is known generically from WO2009/031104 A1.

The powers that can be reached and that are required for supplying electromagnetic radiation at a wavelength in the range of extreme ultraviolet radiation (EUV radiation) have progressively increased in recent years. As a consequence of this, the structural component parts of EUV radiation sources, particularly the electrodes employed, are exposed to increasingly higher thermal loading. One option for cooling the electrodes is to construct the electrodes as disk electrodes and to let a portion of the circumference of these disk electrodes rotate through a bath of liquid material. The material adheres to the surface of the disk electrodes and essentially forms a protective film to prevent erosion of the electrode surface due to high-current discharges which at high frequency take place every time at a new location on the surface of the rotating disk electrodes. The high-current discharge takes place in a discharge position at which two disk electrodes are separated from one another by the smallest distance. The surface is constantly regenerated so as to be available for each discharge by re-coating the discharge locations at the disk electrode through the liquid bath within a complete revolution of the electrode.

In addition to the continual regeneration of the surfaces of the disk electrodes, it is ensured by rotating disk electrodes immersing on one side in a tempered bath of liquid material above all that the surfaces of the disk electrodes are cooled and, as the case may be, also electrically contacted so that a more stable generation of plasma and radiation can be achieved.

Because of the higher powers aimed for in devices for the generation of short-wavelength electromagnetic radiation, particularly EUV radiation, preferably in the range of 13.5 nm, based on a gas discharge plasma, it is necessary to increase the speed of the electrodes in order to ensure sufficient cooling of the electrodes. Further, high discharge frequencies at the discharge position require that the disk electrodes be moved fast enough so that there is always a location on the surface thereof provided with "fresh" coating material so that plasma generation is not allowed to take place at a bare surface of the disk electrodes. Due to the fact that the coating material is supplied more rapidly owing to increased rotational speeds, the aim is to generate very uniform, thin layers on the electrodes so as to reduce variations in thickness of the coating, which prevents spinning off of droplets and ensures consistent discharge conditions in case the coating material is used at the same time for electric contacting of the electrodes and/or as emitter material for the generation of plasma and radiation.

A radiation source in which rotating disk electrodes are rotated through a reservoir of liquid metal which is selected as both coating material and emitter material is known from U.S. Pat. No. 7,630,475 B2. While passing through the liquid metal, the disk electrodes are cooled and, at the same time, a film of liquid metal forms on the surface of the disk electrodes, this film being transported by the rotation of the disk electrodes to the discharge position, where it is evaporated by impingement of laser radiation. Due to a current flowing through the evaporated coating material, a plasma is formed and extreme ultraviolet (EUV) radiation is emitted by compression of the plasma.

For uniformly providing a coating material at the discharge position, U.S. Pat. No. 7,630,475 B2 discloses wipers arranged at a distance (gap) from the surface of each disk electrode. Excess coating material is wiped away from the disk electrodes by the wipers. The thickness of the layers which are achieved in this way is determined by the dimensioning of the gap. As of the priority date of the above-cited document (2006), gap widths were commonly about 100 μm and variations in gap width of up to 20 μm could be tolerated without reservation. Further, in view of the fact that the disk electrodes were rotated at low rotational frequencies of around 8.5 Hz and had diameters of less than 10 cm (e.g., 97 mm), peripheral speeds were only around 2.5 m/s. Therefore, devices according to U.S. Pat. No. 7,630,475 B2 could be operated without major problems.

Further, a device in which two disk electrodes are guided through a bath of liquid coating material is known from WO2009/031104 A1. A wiper is associated with each disk electrode and is arranged so as to be stationary with respect to a rotational direction of the respective disk electrode. The wiper has two legs which are arranged, respectively, along a region of each lateral surface of the disk electrode. The legs are connected transverse to the circumferential direction of the disk electrodes by a crosspiece so that the wiper has a U-shaped form. The wiper is arranged so as to overlap a circumferential surface so that excess liquid coating material is removed from the surfaces of the disk electrodes during a rotation of the disk electrodes. Rotational frequencies of 18 Hz can be achieved by a device of this kind; the problem of higher rotational frequencies has already been addressed. Due to centrifugal forces, the increase in the layer thickness brought about at rotational frequencies above 18 Hz can lead to formation of droplets of the coating material located on the surface of the disk electrodes. In order to prevent or at least reduce such droplets, particularly thin layers should be provided, preferably on the order of a few micrometers (e.g., 5 μm). However, producing such small gap dimensions between the disk electrode and wiper is very uneconomical and very demanding in technical respects relating to adjustment.

SUMMARY OF THE INVENTION

It is the object of the invention to find a novel possibility for generating short-wavelength electromagnetic radiation based on a gas discharge plasma in which rotating disk electrodes are coated with a liquid coating material, wherein formation of droplets of coating material is extensively suppressed even at higher rotational frequencies and a uniform layer thickness of the coating material on the electrode surfaces is ensured at the same time.

According to the invention, in a device for generating short-wavelength electromagnetic radiation based on a gas discharge plasma comprising two disk electrodes which are rotatable in opposite directions and which are provided with oppositely located discharge regions for generating the radiation-emitting plasma, wherein each disk electrode has two lateral surfaces and a circumferential surface and a rotational direction around an axis of rotation in each instance and is provided with a reservoir with a liquid coating material and a wiper for removing excess liquid coating material from surfaces of the disk electrodes, wherein the wiper is arranged so as to be stationary with respect to the rotational direction of the disk electrode and has a U-shaped form comprising two legs parallel to the lateral surfaces of the disk electrode and a crosspiece transversely over the circumferential surface of the disk electrode so that the wiper forms a gap on all sides with the lateral surfaces and the circumferential surface of the disk electrode, the above-stated object is met in that the wiper is at least axially movably supported and has impingement elements at the legs so that it is automatically axially adjustable by means of the coating material which is transported on the lateral surfaces of the disk electrode and pressed into the gap during the rotation of the disk electrode.

The at least axially movable bearing support of the wiper and the impingement elements formed at the latter make it possible to compensate pressure forces caused by the coating material which adheres to the disk electrode and which is pressed into the gap. Therefore, the coating material which remains on the surface of the disk electrode and does not impinge on the impingement elements brings about an equilibrium of pressure forces at the legs of the wiper. The impingement elements, which will be explained in greater detail in the following through their special form of impingement surfaces, deflect excess coating material and cause determined flow paths in a retaining region located in front of the wiper in rotational direction. The flow paths generated on both sides of the disk electrode at the wiper are determined by the coating material that is deflected in a defined manner in the retaining region and cause a compensated backpressure in the gap between the legs of the wiper and the lateral surfaces of the disk electrode; with increased backpressure—as occurs at higher peripheral speeds of the disk electrodes—a greater proportion of the pressure forces is operative in the gap and ensures the axially floating guidance for purposes of a self-adjustment of the wiper.

As a result of the movement of the disk electrode through the reservoir with liquid coating material, the latter is partially entrained by the disk electrode such that the coating material is conveyed and adheres so as to be transported along with it. The coating material adheres to the surfaces of the disk electrode because of adhesive forces, and the adhesion is influenced, preferably increased, by a suitable pre-coating (wetting base coating) and/or texturing of the disk electrode. At higher rotational frequencies, for example, at 18 to 32 Hz, the coating material is pressed with considerable force against the impingement elements of the wiper and into the gap, the coating material on both sides of the disk electrode being pressed into the gap so that the occurring forces are counterbalanced and the wiper which is formed so as to be axially movable is centered axially with respect to the axis of rotation by the action of the forces. By means of this arrangement of the device according to the invention, inaccuracies in the manufacture of the disk electrodes and of the wiper as well as movements of the disk electrodes in radial and axial direction can be automatically compensated in an advantageous manner.

The coating material can be, for example, tin, tin alloy, lithium or sodium. The coating material is preferably electrically conductive and metallic.

Exactly one wiper is advisably associated with each disk electrode. The wiper has as impingement elements at each leg at least one impingement surface with a radially inner end and a radially outer end. At least an outer portion at the radially outer end is set back in rotational direction from an inner portion at the radially inner end of the impingement element, and the portions are connected in each instance by slopes so that excess coating material which is located on the disk electrode and flows against the impingement elements in rotational direction is directed outward radially. The impingement surfaces of the legs of the wiper are formed so as to correspond mirror-symmetrically to the disk electrode.

Further, impingement surfaces can be formed in vertical direction orthogonal to the configuration of impingement elements in radial direction such that the excess coating material that is stripped off is guided away from the surface of the disk electrode. The coating material is preferably guided off either in the form of a self-contained wave, as a directed flow, or in a combination of like guided flows. The excess, stripped-off coating material is guided in each instance into a collection area located above the lateral surfaces of the disk electrode and in front of the legs of the wiper with respect to the rotational direction.

An impingement surface in the form of a fillet which is shaped in rotational direction is advantageously formed as impingement element. In further embodiments, the profile and dimensioning of other impingement surfaces, as impingement elements, can either alternate abruptly or transition smoothly into one another within or between the portions. Combinations of the above embodiments are also possible.

In a preferred embodiment, the reservoir is constructed as a furrow-shaped depression in a housing enclosing the disk electrode or in a frame associated with the disk electrode. The reservoir can have a narrowed cross section at its exit area where the disk electrode is rotated out of the reservoir again in order to scrape off some of the excess coating material from the lateral surfaces and circumferential surface already in the exit area. It is advantageous when the reservoir can receive a greater volume of coating material over a middle portion of its longitudinal extension. The reservoir can be heatable in a controlled manner and can have a feed for coating material through which fresh or recycled coating material can be supplied to the reservoir.

To prevent the radially outwardly guided material from directly flowing off from the disk electrode, a border can be provided at the radially outer end of the leg so as to be directed opposite the rotational direction. By means of a border of this kind, radially outwardly directed coating material is guided back again in direction of the collection area such that this border may also be considered as an impingement element for the self-adjustment of the wiper. In other words, this lowers the risk of excess coating material overflowing the wiper or overcoming the wiper along the circumferential surface of the disk electrode.

In a further embodiment of the device according to the invention, there is provided a housing with an interior space for receiving and spatially positioning the disk electrode, the reservoir for the coating material and the wiper, wherein the housing is open at least at a cutout and the disk electrode is exposed in this cutout so as to form a discharge region with the second, opposed disk electrode which is likewise exposed.

According to a further embodiment, the wiper can also advantageously be mounted so as to be movable radially. In this case, means for applying a compensating force are advantageously associated with the wiper, wherein the compensating force is directed with respect to amount and direction opposite to a radial force resulting from the coating material being accelerated outward due to the rotation of the disk electrode. Means for applying the compensating force can be a spring or a spring system. In so doing, the means for applying the compensating force can have a linear or nonlinear response and can be controllable. Control can be carried out, for example, as a function of an actual rotational frequency of the disk electrode.

In a special advantageous embodiment of the device according to the invention, a return channel is provided for receiving stripped-off excess coating material, wherein the coating material can be conveyed into the return channel by a backpressure generated at the wiper as a result of the rotating disk electrode and can be returned to the reservoir via the return channel.

It is further advantageous when the coating material is not introduced into the return channel directly through the action of the disk electrode. Instead, the removed excess coating material can flow away from the wiper opposite to the rotational direction of the disk electrode. This returning coating material arrives at an inlet opening of the return channel and is pushed into the inlet opening and into the return channel by the pressure of the entering coating material.

In a preferred embodiment, the return channel is arranged external to the housing and has an inlet opening for supplying the stripped-off excess coating material and an outlet opening for discharging the coating material transported through the return channel, wherein the return channel communicates with the interior space of the housing via the inlet opening directly in front of the wiper and via the outlet opening in the region of the reservoir.

The return channel is preferably dimensioned such that it is filled by the coating material conveyed into the return channel only when the rotating disk electrode has reached a peripheral speed of at least 20 m/s. If the disk electrodes have a diameter of 200 mm, their peripheral speed at a rotational frequency of 32 Hz is around 20 m/s. This configuration of the return channel advantageously ensures that the stripped-off liquid material is conducted out of the area of the wiper without disadvantageous stagnation effects due to the return channel. This prevents the stripped-off coating material from disadvantageously flowing around the wiper. In further embodiments of the device according to the invention, the frequencies can be, e.g., 20, 25 and 30 Hz and the associated peripheral speeds can be less than 20 m/s.

Further, a critical lowering of the fill level in the reservoir is countered through a sufficiently large volume of the return channel. Aside from ensuring a continual coating of the disk electrode, a sufficiently high fill level also improves compliance with electrical operating parameters of the device. Thus the disk electrodes can be electrically contacted via a liquid, electrically conductive coating material, e.g., liquid tin, in the reservoir. A plasma required for the generation of the EUV radiation can be generated by a flow of current through the reservoir, coating material and disk electrode.

For a reliable functioning of the device according to the invention, it is advantageous when the wiper is configured in such a way that the stripped-off excess coating material is directed into a collection area located in front of the wiper in rotational direction and the inlet opening of the return channel is dimensioned and positioned in such a way that the coating material can be moved out of the entire collection area into the return channel.

During operation of the device according to the invention, the reservoirs of the two disk electrodes are filled with liquid coating material. The coating material serves to protect the disk electrode from erosion caused by electric discharges. Further, the disk electrode is cooled by the coating material. Beyond this, the coating material can advantageously be used for generating EUV radiation through a gas discharge plasma when the coating material is simultaneously a suitable material, e.g., tin, for EUV emission. The disk electrodes are guided by a portion of their surface through the coating material and, in so doing, are rotated around an axis of rotation in each instance. The surface of the disk electrode is coated by the coating material at least in a region of the disk electrode immersed in the reservoir, and a film of coating material is formed on the surface of each of the disk electrodes. By further rotation of the disk electrode, the film is transported out of the reservoir. The film is also held on the surface outside of the reservoir through adhesion. When the film reaches the wiper, all of the coating material located on the disk electrode above a clearance gap between the surface of the disk electrode and the wiper is stripped off. The coating material which is pressed into the gap causes a pressure force on the borders of the gap. This pressure force acts on both sides of the disk electrode so that the axially movably arranged wiper is automatically adjusted and is centered with respect to the width of its gap relative to the surface of the disk electrode. Further, the pressure force is influenced by the backpressure on each side of the disk electrode.

The excess, stripped-off coating material accumulates in the collection area. It arrives in the return channel through the inlet opening, flows through the return channel and passes into the reservoir through the outlet opening. It is accordingly returned and recycled as coating material.

It is also possible that, rather than the coating material itself, an emitter material supplied in some other way is evaporated by supplied energy, e.g., by means of laser radiation, and the electric discharge takes place through the evaporated emitter material leading to plasma generation with EUV emission. For example, the emitter material can be introduced by injection of droplets into the discharge region between the disk electrodes as is known, e.g., from U.S. Pat. No. 7,531,820 B2, U.S. Pat. No. 7,619,232 B2 and U.S. Pat. No. 7,800,086 B2. The emitter material to be evaporated and the coating material can both be tin, for example. However, if the EUV emission is generated by an injected, evaporated emitter material that is converted into plasma, the coating material can be optimized particularly to protect against erosion of the disk electrodes and for the electrical contacting thereof.

The invention makes possible the generation of short-wavelength electromagnetic radiation based on a gas discharge plasma in which rotating disk electrodes are coated with liquid coating material, and formation of droplets of coating material is substantially suppressed even at higher rotational frequencies, and a uniform layer thickness of coating material on the electrode surfaces is ensured at the same time.

BRIEF DESCRIPTION OF THE DRAWINGS

The device according to the invention will be described more fully in the following with reference to embodiment examples and drawings. The drawings show.

DETAILED DESCRIPTION OF THE PREFERRED EMBODIMENTS

Figure 1:
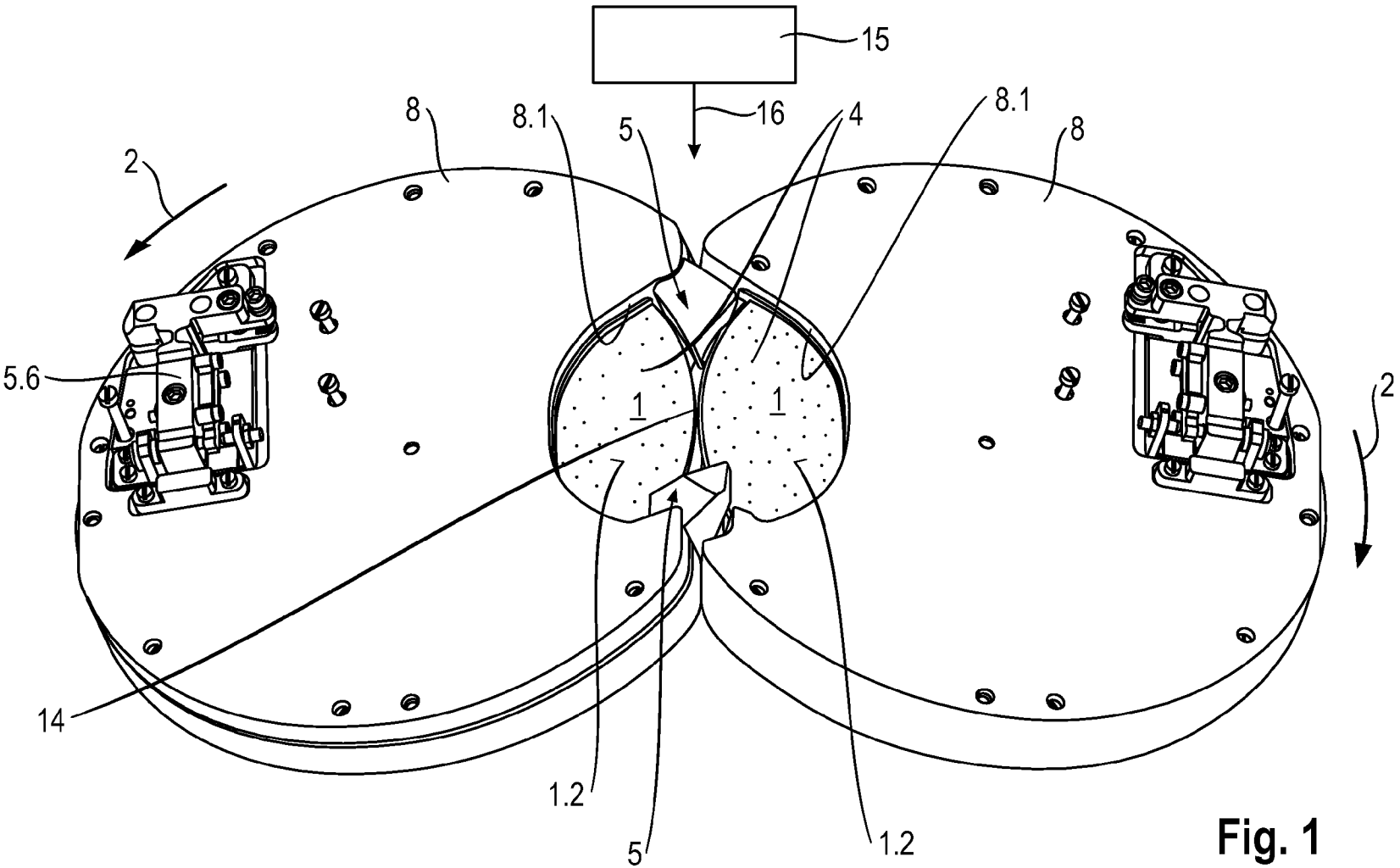
FIG. 1 a view of the first embodiment example of a device according to the invention with two disk electrodes and an excitation source.

A device according to the invention for generating extreme ultraviolet radiation (EUV radiation) by means of a gas discharge is shown schematically in FIG. 1. The device according to the invention comprises, as essential elements for the plasma generation by means of gas discharge, two disk electrodes 1 respectively located in a housing 8, each disk electrode 1 having a wiper 5.

The two disk electrodes 1 are guided respectively at a portion of their periphery and an outer radiation region of their lateral surfaces in a reservoir 3 (see FIG. 2) which is filled with a liquid coating material 4. They have an exposed region at another part of their periphery. The exposed regions are due in each instance to a cutout 8.1 in the respective housing 8. The disk electrodes 1 are near one another, i.e., have their shortest distance from one another, at these exposed regions. The location where the two disk electrodes 1 are closest together defines the discharge region 14 for the electric discharge for generating a gas discharge plasma. A wide variety of options is known from the prior art (e.g., sliding contact, contacting via the reservoir with metallic coating material, etc.) for the electric contacting of the disk electrodes 1, any one of which may be selected. In this example, the coating material 4 is tin and is accordingly also suitable for electric contacting.

In a preferred embodiment in which the coating material 4 simultaneously serves as emitter material, a laser beam 16 is directed to at least one of the disk electrodes in the discharge region 14. In the discharge region 14, the coating material 4 (shown only schematically) is acted upon by energy and evaporated by the action of the laser beam 16. A flow of current is then initiated between the two disk electrodes 1 through the evaporated coating material 4 by means of a triggered electric discharge and plasma is generated, the desired EUV radiation being emitted when this plasma is compressed.

Figure 2:
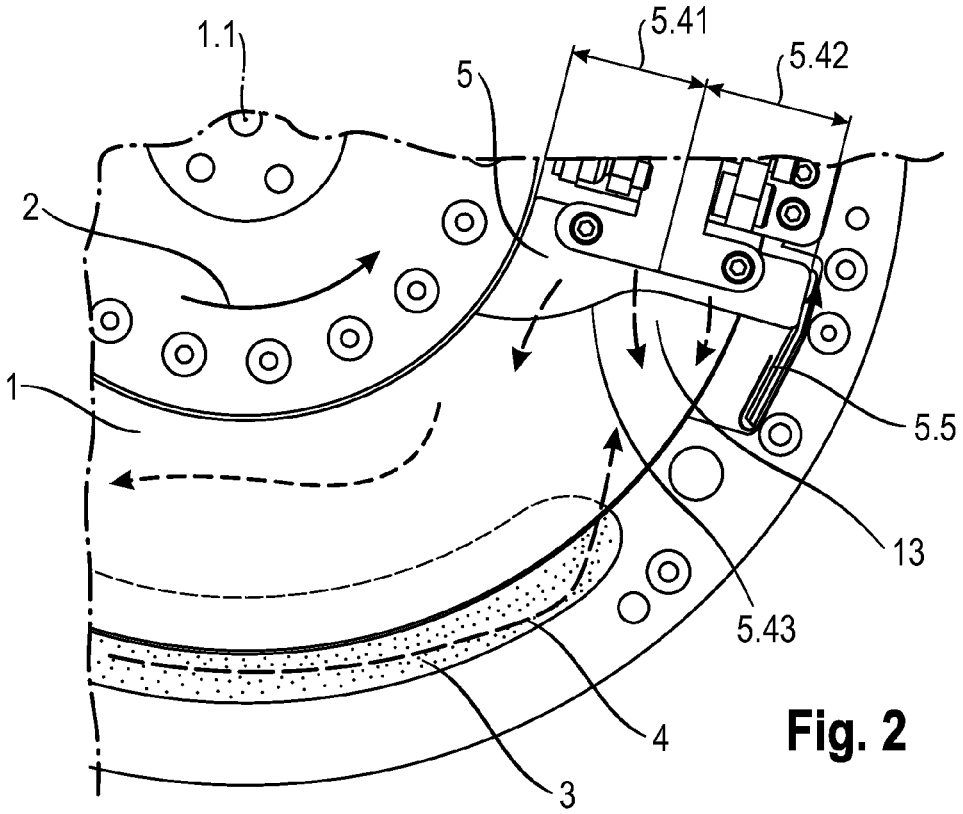
FIG. 2 a schematic view of a first embodiment example of disk electrode, reservoir and wiper of the device according to the invention.

As is shown in FIG. 2, the disk electrode 1 is rotatable in a rotational direction 2 around an axis of rotation 1.1. The reservoir 3 has a curved shape, extends via a defined sector along the circumference of the disk electrode 1 and is adapted to the outer radius of the disk electrode 1. The disk electrode 1 and the reservoir 3 are positioned relative to one another such that the disk electrode 1 is guided by its circumference and by the outer radial area of its lateral surfaces 1.2 through the reservoir 3.

The wiper 5 is arranged following the reservoir 3 in rotational direction 2 and has, with respect to the radial direction of the disk electrode 1, impingement elements in the form of an inwardly located first radial portion 5.41 and an outwardly located second radial portion 5.42. The first radial portion 5.41 has a radially outer curve shape extending in rotational direction 2. The second radial portion 5.42 is set back relative to the first radial portion 5.41 in rotational direction 2. The first radial portion 5.41 and the second radial portion 5.42 are connected respectively by a slope 5.43. A border 5.5 directed opposite the rotational direction 2 is formed integral with the radially outer end of the wiper 5. A collection area 13 is formed (at three sides) on the surface of the disk electrode 1 in front of the wiper 5 with respect to the rotational direction 2.

Figure 3:
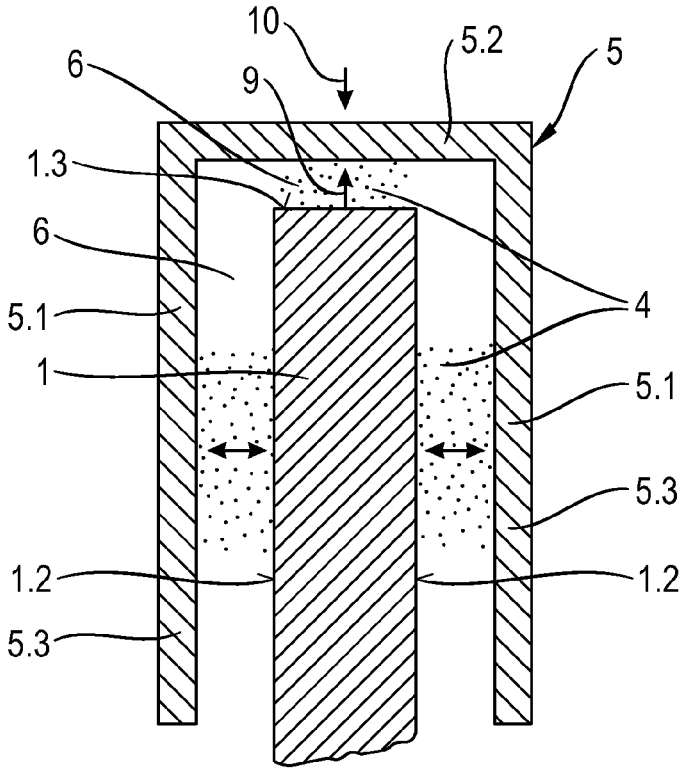
FIG. 3 a simplified view of the wiper at a disk electrode.

The functional principle of a wiper 5 is illustrated in a simplified manner in FIG. 3. The wiper 5 has two legs 5.1 which extend parallel to one another and are connected to one another in the shape of a U by a crosspiece 5.2. The wiper 5 is arranged so as to reach over the disk electrode 1 in the manner of a saddle, the crosspiece 5.2 is arranged parallel to the circumferential surface 1.3 of the disk electrode 1 and the legs 5.1 are arranged parallel to a lateral surface 12 in each instance. A gap 6 is formed on all sides between the disk electrode 1 and the wiper 5. When the device is used as designated, the gap 6 is filled with a liquid coating material 4. The coating material 4 is transported into the gap 6 through a rotational movement of the disk electrode 1. When the coating material 4 fills the gap 6 between a lateral surface 1.2 and the leg 5.1 which is arranged over the respective lateral surface 1.2, a pressure force (indicated by double arrows) acting on all sides is generated by the coating material 4. As a result of this pressure force, the wiper 5 is held at a distance (gap 6 on all sides) from the disk electrode 1. A pressure force also acts on the oppositely located lateral surface 1.2 due to the coating material 4 present at that location. When the coating material 4 is pressed into the gap 6 on both sides of the disk electrode 1 with equal force and the width of the gap 6 is equal on both sides, the acting pressure forces are also equal and effectively cancel each other. On the other hand, if the width of the gap 6 is smaller on one side than on the other side, less coating material 4 is pressed into the gap 6 on the side having the smaller width. Owing to frictional resistance and fluid resistance, the velocity of the coating material 4 in the gap 6 decreases and the pressure increases in a known manner. The pressure force caused by the increased pressure is greater than the pressure force that is brought about between the other lateral surface 1.2 and the other leg 5.1 (gap 6 with the greater width). With differences in pressure force, this leads to a resulting displacement in direction of the lower pressure force until an equilibrium state is restored. A dynamic centering of the wiper 5 is achieved by means of this alternating relationship of pressure forces and widths of the gap 6.

Further, the circumferential surface 1.3 is also coated with coating material 4 when the disk electrode 1 passes through the reservoir 3. As disk electrode 1 continues to rotate, this coating material 4 is accelerated in radial direction and possibly spun off tangentially. If the coating material 4 is pressed between the circumferential surface 1.3 and crosspiece 5.2, a pressure force which is caused by the coating material 4 and referred to as radial force 9 also takes effect. To prevent the wiper 5 from lifting in radial direction, a compensating force 10 is applied to the crosspiece 5.2 which counteracts and cancels the radial force 9.

Figure 4:
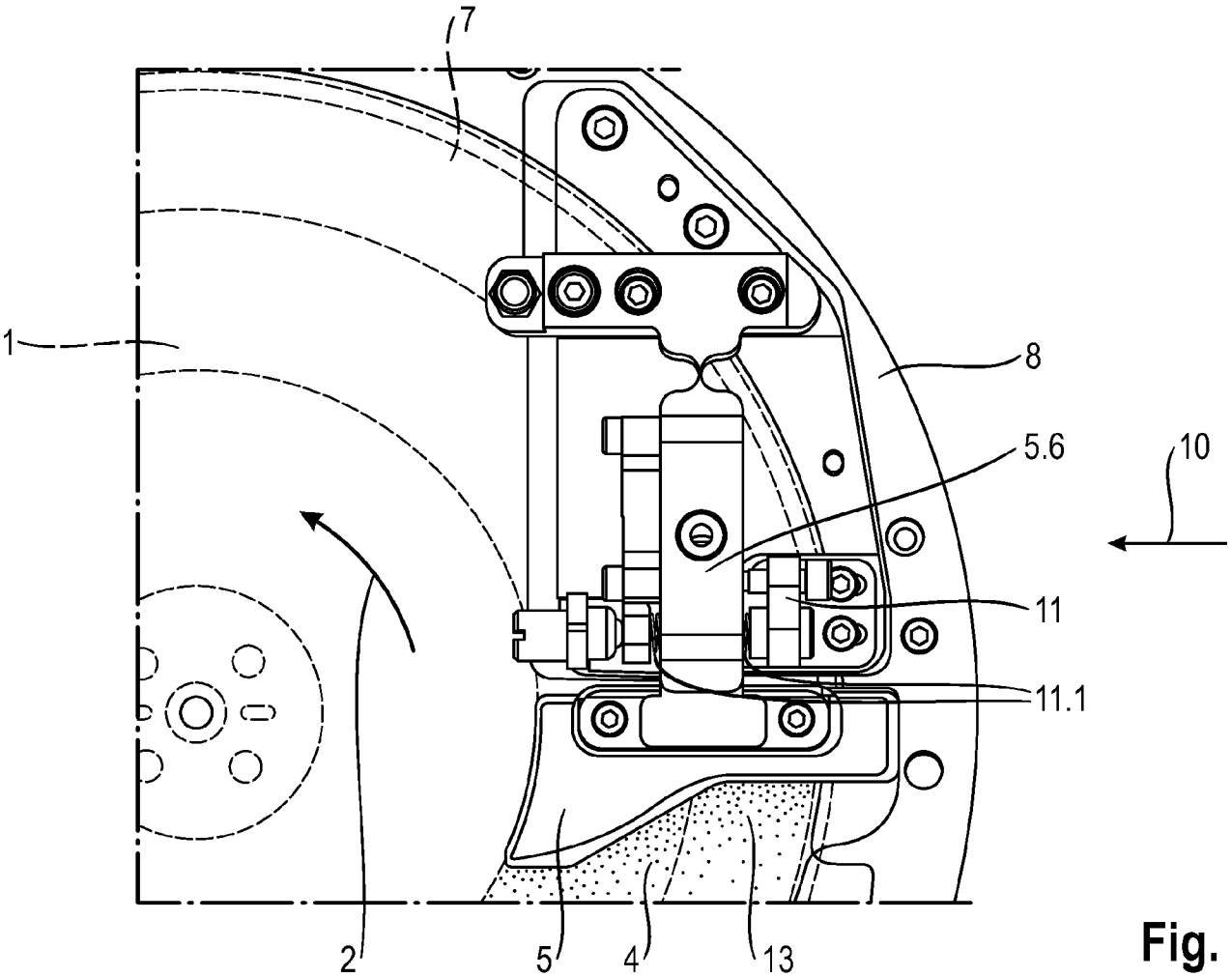
FIG. 4 a top view of a second embodiment example of disk electrode, reservoir, wiper and housing of the device according to the invention.

FIG. 4 shows how a compensating force 10 is generated for a second embodiment example. The wiper 5 is positioned relative to the disk electrode 1 by means of a holder 5.6. The holder 5.6 is fastened to a housing 8 enclosing the disk electrode 1 such that the wiper 5 is displaceable in radial direction by a certain amount. To bring about the compensating force 10 (indicated by the arrow), means for applying a compensating force 11 in the form of a spring 11.1 are arranged in such a way that the wiper 5 which is urged radially outward by the radial force 9 is pressed against the spring 11.1. The spring force caused by the spring 11.1 is directed counter to the radial force 9 in direction and amount as compensating force 10.

FIG. 4 further shows that the housing 8 defines an interior space 7 in which the disk electrode 1 and the reservoir 3 (not shown) are arranged. Coating material 4 is guided against the wiper 5 and into the gap 6 (see FIG. 3) by the disk electrode 1 rotating in rotational direction 2. The portion of coating material 4 stripped off by the wiper 5 is retained in the collection area 13 in front of the wiper 5.

Figure 5:
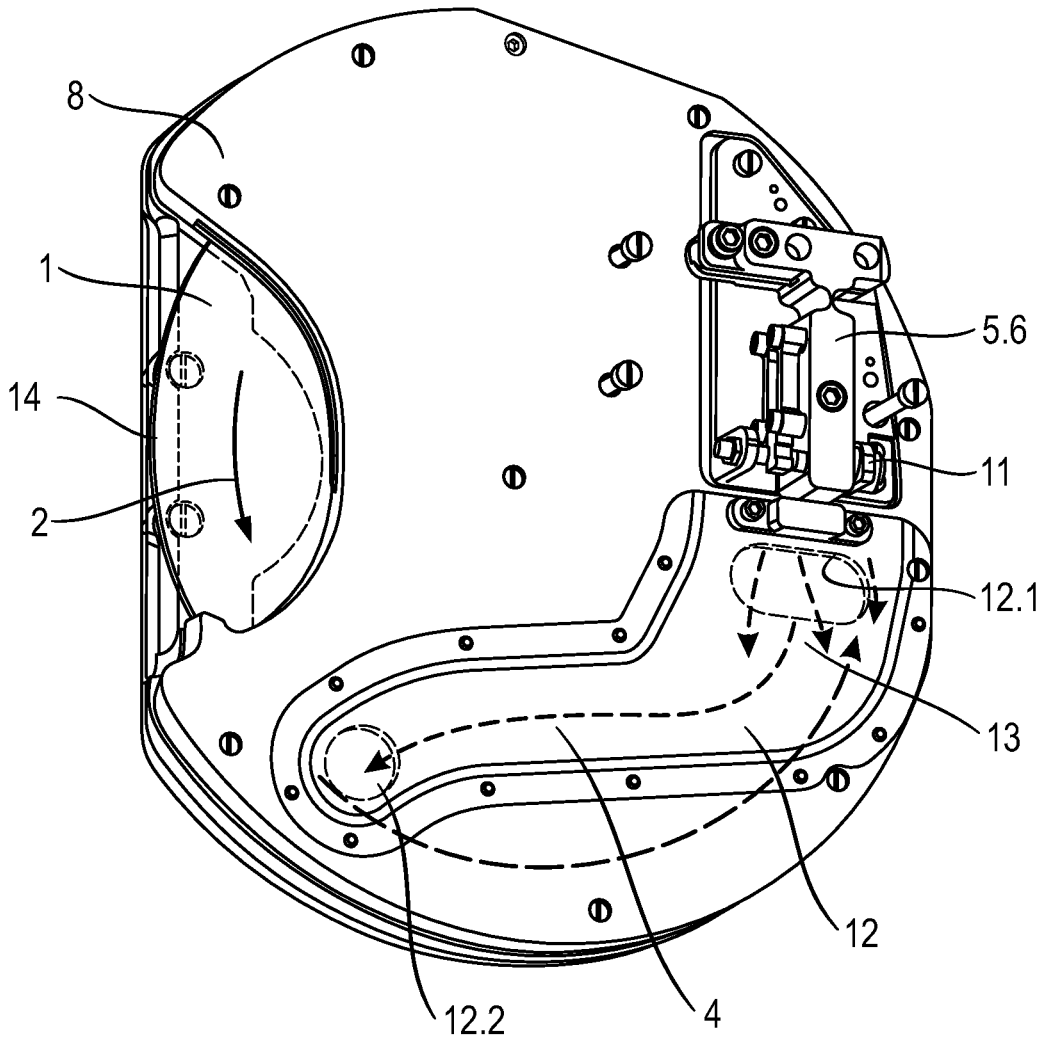
FIG. 5 a schematic view of a second embodiment example of the device according to the invention with housing and return channel.

A second embodiment example of the device according to the invention is shown in a simplified manner in FIG. 5. The disk electrode 1 and the reservoir 3 are almost completely enclosed by the housing 8. The holder 5.6 and the means for applying a compensating force 11 are arranged on the housing 8. The housing 8 is open by segments so that a peripheral portion of the disk electrode 1 emerges from the housing 8 and is exposed. A discharge region 14 in which the coating material 4 can be evaporated by supplying energy can be arranged in this region of the disk electrode 1.

A return channel 12 is provided on the part of the housing 8 covering the lateral surfaces 1.2 of the disk electrodes 1. This return channel 12 has an inlet opening 12.1 opening into the collection area 13 through the housing 8 and an outlet opening 12.1 opening into the reservoir 3 through the housing 8. The free cross-sectional area of the return channel 12 is sufficiently large to allow coating material 4 (see FIG. 6) arriving through the inlet opening 12.1 in the return channel 12 to flow freely through the latter without leading to a disadvantageous stagnation of coating material 5 in the region of the inlet opening 12.1.

During the rotation of the disk electrode 1 in rotational direction 2, coating material 4 is transported out of the reservoir 3 in direction of the wiper 5 (see FIG. 4). Excess coating material 4 is stripped off from the disk electrode 1, retained and directed into the collection area 13 by the wiper 5. From the collection area 13, the excess coating material 4 arrives in the return channel 12 via the inlet opening 12.1. The coating material 4 (indicated by the dashed arrow) flows through the return channel 12 and passes back into the reservoir 3 through the outlet opening 12.1. This appreciably reduces the fresh supply of coating material 4 from outside into the reservoir 3 and at the same time prevents excess coating material 4 from flowing off or overflowing into the discharge region 13 in an unwanted, uncontrolled manner.

Figure 6:
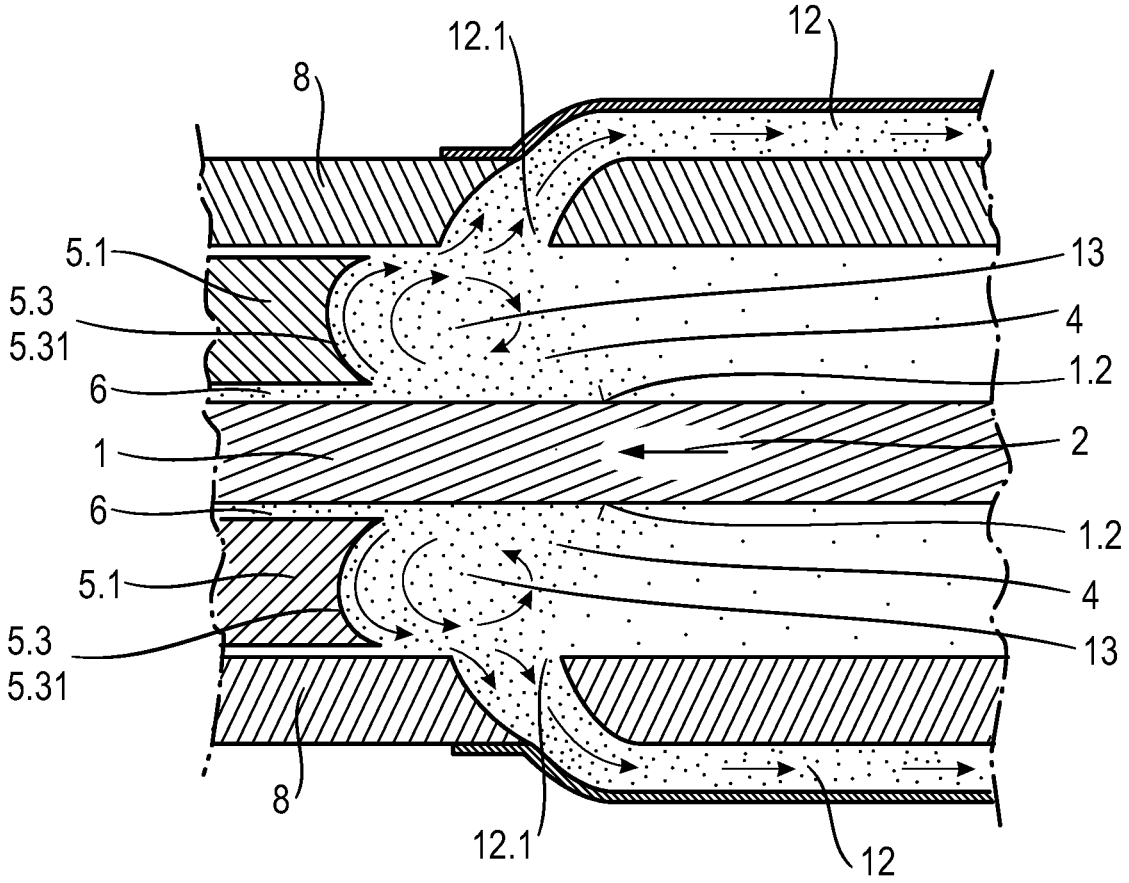
FIG. 6 a schematic depiction of the flow conditions at a wiper and a return channel.

FIG. 6 shows the processes at a wiper 5 in a simplified manner. After passing through the reservoir 3 (not shown), there is a layer of adhering coating material 4 on the disk electrode 1 which forms a film of indeterminate thickness on the lateral surfaces 1.2 of the disk electrode 1, only a section of which is shown. The coating material 4 is guided over each lateral surface 1.2 against an impingement element 5.3 of the leg 5.1, which impingement element 5.3 is shaped as a fillet 5.31. Each impingement element 5.3 is formed at a leg 5.1 and arranged so as to be oriented opposite to the rotational direction 2 and parallel to the respective lateral surface 1.2. A portion of the coating material 4 is transported through the gap 6 so that there is a determined thickness of the film of coating material 4 after the gap 6. Excess coating material 4 that is stripped off by the leg 5.1 is guided away from the disk electrode 1 along the impingement element 5.3. The coating material 4 is retained but remains in motion. Owing to the shape of the impingement element 5.3 and a border of the collection area 13 provided in front of the impingement element 5.3 by the housing 8, the coating material 4 is circulated in the collection area 13. The coating material 4 then arrives in the return channel 12 when more coating material 4 is added by the disk electrode 1 per unit of time than can pass through the gap 6 per unit of time and the collection area 13 is filled. When further coating material 4 surges out of the collection area 13 through the inlet opening 12.1 into the return channel 12, the coating material 4 already present in the return channel 12 is pushed further through the return channel 12.

In a further embodiment of the device, the wiper 5 and the return channel 12 can also be positioned and oriented such that the coating material 4 flows through the return channel 12 due to the action of gravity.

REFERENCE NUMERALS

1 disk electrode
1.1 axis of rotation
1.2 lateral surface
1.3 circumferential surface
2 rotational direction
3 reservoir
4 coating material
5 wiper
5.1 leg
5.2 crosspiece
5.3 impingement element
5.31 fillet
5.4 impingement element
5.41 first radial portion
5.42 second radial portion
5.43 slope
5.5 border
5.6 holder
6 gap
7 interior space
8 housing
8.1 cutout
9 radial force
10 compensating force
11 means for applying a compensating force
11.1 spring
12 return channel
12.1 inlet opening
12.2 outlet opening
13 collection area
14 discharge region
15 excitation source
16 laser beam

What is claimed is:

1. A device for generating short-wavelength electromagnetic radiation based on a gas discharge plasma, the device comprising:

two disk electrodes rotatable in opposite directions and comprising oppositely arranged discharge regions for generating the radiation-emitting plasma;

wherein each disk electrode is characterized by an axis of rotation and comprises two lateral surfaces and a circumferential surface, each disk electrode comprising a reservoir with a liquid coating material and a wiper for removing excess liquid coating material from surfaces of the disk electrode;

wherein the wiper of each disk electrode is arranged to be stationary with respect to the rotational direction of the disk electrode, the wiper comprising:

a U-shaped form comprising two legs parallel to the lateral surfaces of each disk electrode and a crosspiece transversely over the circumferential surface of each disk electrode, so that the wiper forms a gap on all sides with the lateral surfaces and the circumferential surface of each disk electrode, the wiper being at least axially movably supported an axially movable mount and has impingement elements at the legs so that it is automatically axially adjustable by means of the coating material which is transported on the lateral surfaces of the disk electrode and pressed into the gap during the rotation of each disk electrode.

2. The device according to claim 1, wherein the wiper comprises at least one impingement element with a radially inner end and a radially outer end at each leg, wherein at least an outer portion at the radially outer end is set back in the rotational direction from an inner portion at the radially inner end of the impingement element, and the inner and outer portions are connected by slopes extending diagonally radially outwardly in rotational direction, so that excess coating material located on each disk electrode flowing against the impingement element in rotational direction is directed outward radially.

3. The device according to claim 2, further comprising a fillet shaped in the rotational direction, the fillet being provided as further impingement element.

4. The device according to claim 1, further comprising a border disposed at a radially outer end of the leg so as to be directed opposite the rotational direction, the border being formed to prevent radially outwardly directed coating material from flowing directly off each disk electrode.

5. The device according to claim 1, further comprising a housing for each electrode, the housing having an interior space for encasing and spatially positioning of each disk electrode, the reservoir for the coating material and the wiper, wherein the housing has at least one cutout for exposing each disk electrode to form a discharge region with its oppositely located disk electrode of the two electrodes which is likewise exposed by a cutout in its housing.

6. The device according to claim 1, wherein the wiper is mounted to be radially movable, wherein means for applying a compensating force are associated with the wiper, and wherein the compensating force has an amount and direction that is opposite to a radial force resulting from the coating material being accelerated outwardly due to the rotation of the disk electrode.

7. The device according to claim 6, wherein the means for applying a compensating force are controllable.

8. The device according to claim 5, further comprising a return channel at each housing for receiving wiped-off excess coating material, wherein the excess coating material is conveyed into the return channel by backpressure generated at the wiper as a result of rotating each disk electrode and wherein the excess coating material is returned to the reservoir via the return channel.

9. The device according to claim 8, wherein the return channel is arranged externally to the housing and has an inlet opening for supplying the wiped off excess coating material and an outlet opening for discharging the coating material transported through the return channel, wherein the return channel communicates with the interior space of the housing via the inlet opening directly in front of the wiper and via the outlet opening in the region of the reservoir.

10. The device according to claim 9, wherein the return channel is dimensioned such that it is filled by the coating material conveyed into the return channel only when each disk electrode has reached a peripheral speed of at least 20 m/s.

11. The device according to claim 8, wherein the wiper is configured to direct the wiped-off excess coating material into a collection area located in front of the wiper in rotational direction, and wherein the inlet opening of the return channel is dimensioned and positioned to move the coating material out of the entire collection area into the return channel.

* * * * *